US005671807A

United States Patent [19]

Lameris

[11] Patent Number: 5,671,807

[45] Date of Patent: Sep. 30, 1997

[54] COOLING APPARATUS

[75] Inventor: Herman Johannes Lameris, Hollandsche Rading, Netherlands

[73] Assignee: Standard Fasel-Lentjes B.V., Netherlands

[21] Appl. No.: 342,413

[22] Filed: Nov. 18, 1994

[30] Foreign Application Priority Data

Nov. 24, 1993 [NL] Netherlands ..... 9302034

[51] Int. Cl.[6] ..... F28F 19/00

[52] U.S. Cl. ..... 165/134.1; 165/158; 165/173; 165/178

[58] Field of Search ..... 165/134.1, 158, 165/173, 174, 175, 178, DIG. 171

[56] References Cited

U.S. PATENT DOCUMENTS

| | | | |
|---|---|---|---|
| 2,365,515 | 12/1944 | Baudry | 165/70 |
| 3,356,135 | 12/1967 | Sayre | 165/158 X |
| 3,974,022 | 8/1976 | Lauro | 165/178 X |
| 4,245,696 | 1/1981 | Van der Lelij | 165/134.1 |
| 4,445,463 | 5/1984 | Casper et al. | 122/7 R |
| 4,537,249 | 8/1985 | Harris | 165/134.1 |
| 4,641,706 | 2/1987 | Haynie | 165/DIG. 171 X |

FOREIGN PATENT DOCUMENTS

| | | | |
|---|---|---|---|
| 0021111 | 1/1981 | European Pat. Off. . | |
| 2424500 | 11/1979 | France . | |
| 1953628 | 5/1971 | Germany . | |
| 5453 | 1/1978 | Japan | 165/134.1 |

*Primary Examiner*—Leonard R. Leo

*Attorney, Agent, or Firm*—Webb Ziesenheim Bruening Logsdon Orkin & Hanson, P.C.

[57] ABSTRACT

The present invention provides a device for cooling a warm medium comprising:

a vessel wherein a bundle of a number of pipes are disposed and wherein coolant medium flows around the pipe bundle;

a pipe plate through which the pipes of the bundle debouch into a reservoir for supply of the warm medium;

a support plate mounted at a distance from the pipe plate whereby the pipes are supported and wherethrough the pipes extend; and one or more rings which are each mounted between a pipe and the support plate on the side of the support plate faced to the pipe plate and which are provided with holes for allowing passage of the coolant.

16 Claims, 2 Drawing Sheets

COOLING APPARATUS

Apparatuses for cooling hot gas are supplied on a large scale to the market for applications such as gasification processes and the like which are for example used by oil companies.

A known such device is described in the U.S. Pat. No. 4,245,696. In practice a number of problems occur with these known cooling devices, the following being the most important:

With a malfunction in the cool waterflow, water, as the coolant medium may boil, whereby the coolant power is strongly reduced.

Due to tension in the relatively thick metal parts, especially under the temperature fluctuations which may occur with a malfunction and/or interruption in the coolant waterflow as well as during taking in and out of the factory of the cooling device; and Because the absolute temperature values reach a high value on some metal parts, wear and tear occurs.

SUMMARY OF THE INVENTION

The present invention provides a device for cooling a warm medium, comprising:

a vessel wherein a bundle of a number of pipes are disposed and wherein coolant medium flows around the pipe bundle;

a pipe plate through which the pipes of the bundle debouch into a reservoir for supply of the warm medium;

a support plate mounted at a distance from the pipe plate whereby the pipes are supported and wherethrough the pipes extend; and one or more rings which are each mounted between a pipe and the support plate on the side of the support plate faced to the pipe plate and which are provided with holes for allowing passage of the coolant.

The cooling device according to the present invention overcomes one or more of the above mentioned problems, due to the fact that the ring-like gap between a pipe and a support plate can be enlarged because the transportation away of unwanted steam is promoted. Further, the temperature tension at the inlet front of the pipes, which is formed by the underside of the support plate at the point where the pipes extend therethrough, is lowered, whereby the thermal tension at that front can be reduced by more than a factor of two. Welding on the rear side of the support plate can be avoided, which makes for a compacter arrangement of the pipes and allows the unsupported areas between the inlet pipes to be smaller, because the inlet front can be made thinner and makes possible a lower absolute temperature on the hot side of the front.

Further advantages, characteristics and details of the present invention will become clear in the light of the following description of preferred embodiments thereof, with reference to the accompanying drawings.

DESCRIPTION OF THE PREFERRED EMBODIMENTS

Figure 1:
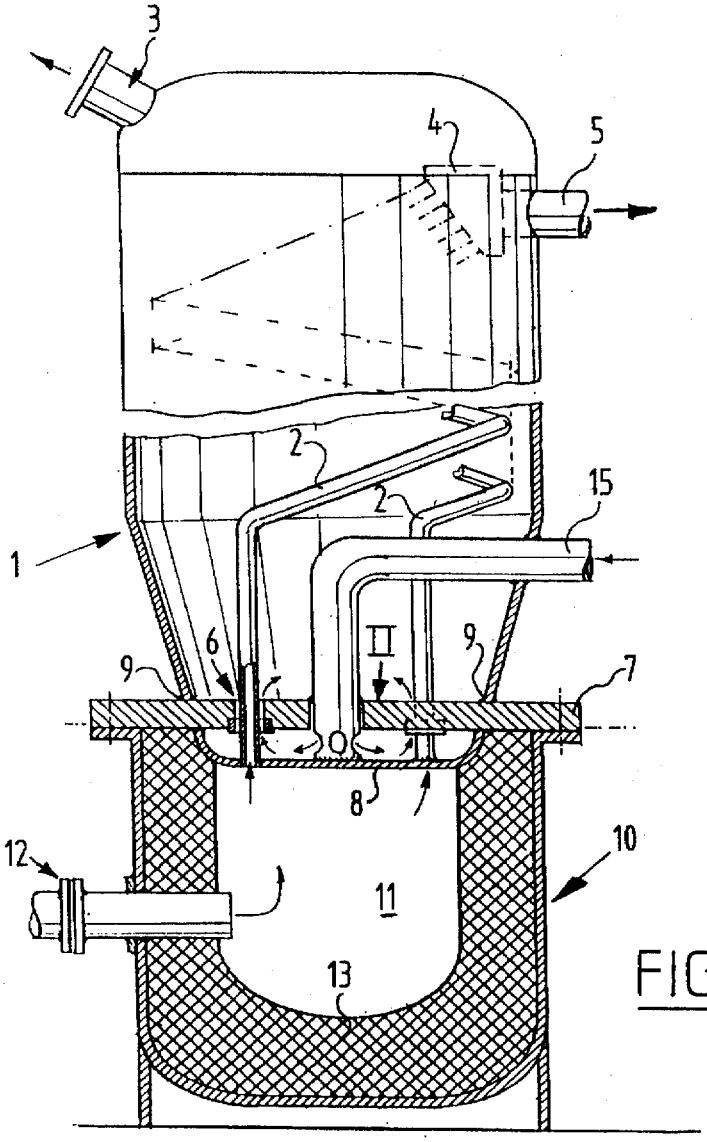
FIG. 1 a side-view, partially broken away and in cross section of a first preferred embodiment according to the present invention.

A first preferred embodiment of the apparatus according to the present invention (FIG. 1) comprises a vessel 1 wherein a bundle of helical like pipes 2 is placed. The vessel has a discharge 3 for coolant medium. The pipes 2 are fixed onto a number of collection headers 4 which are joined to a discharge pipe 5 for gas. The pipes 2 are supported in a reinforced support plate 7 and project through openings 6 thereof. The ends of the pipes are secured in a pipe plate 8 which is for example securely welded by weld joints 9 to the support plate 7. The support plate is welded to the vessel 1. The pipes 2 are preferably welded to the opposing side of the pipe plate from the pipes, making the welding easier.

The support plate 7 is furthermore secured to a vessel 10 which encompasses a chamber 11 for warm gas. This chamber 11 is provided with a supply 12 for the warm gas and is covered on the inside with a thick layer of insulation material which also serves to allow the vessel 10 to offer enough resistance against the gas pressure.

Figure 2:
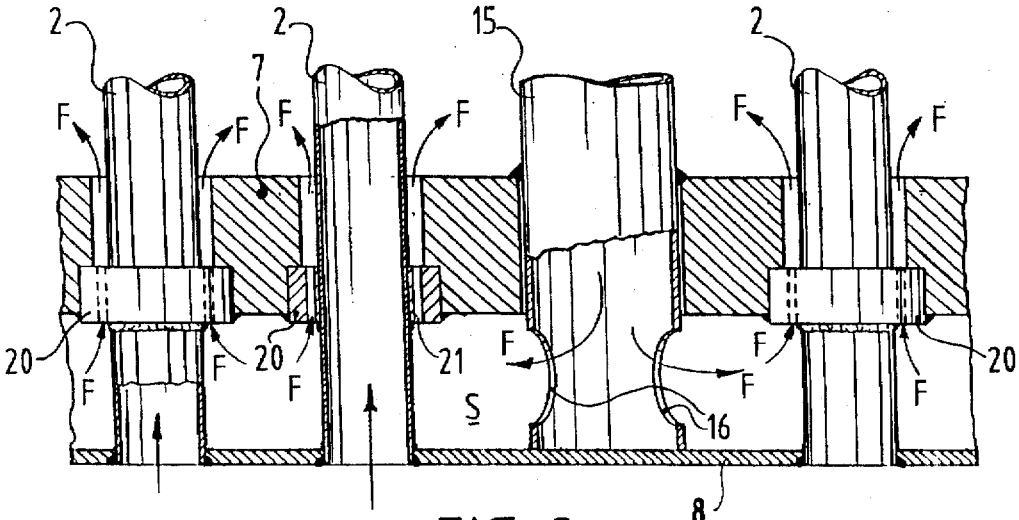
FIG. 2 a partly broken away side view of detail II from FIG. 1.

As shown in FIG. 2 the other side of the pipe plate a ring 20 with holes 21 is also mounted between a pipe 2 and the support plate 7 so that the coolant can flow in sufficient amount (arrows F) in the area S between the pipe plate and the support plate. The coolant is transported via a pipe 15 with a relatively large cross-section through the support plate 7 on which the pipe is securely welded, into the area S through openings 16 nearby the end thereof secured to the pipe plate 8.

Figures 3, 4:
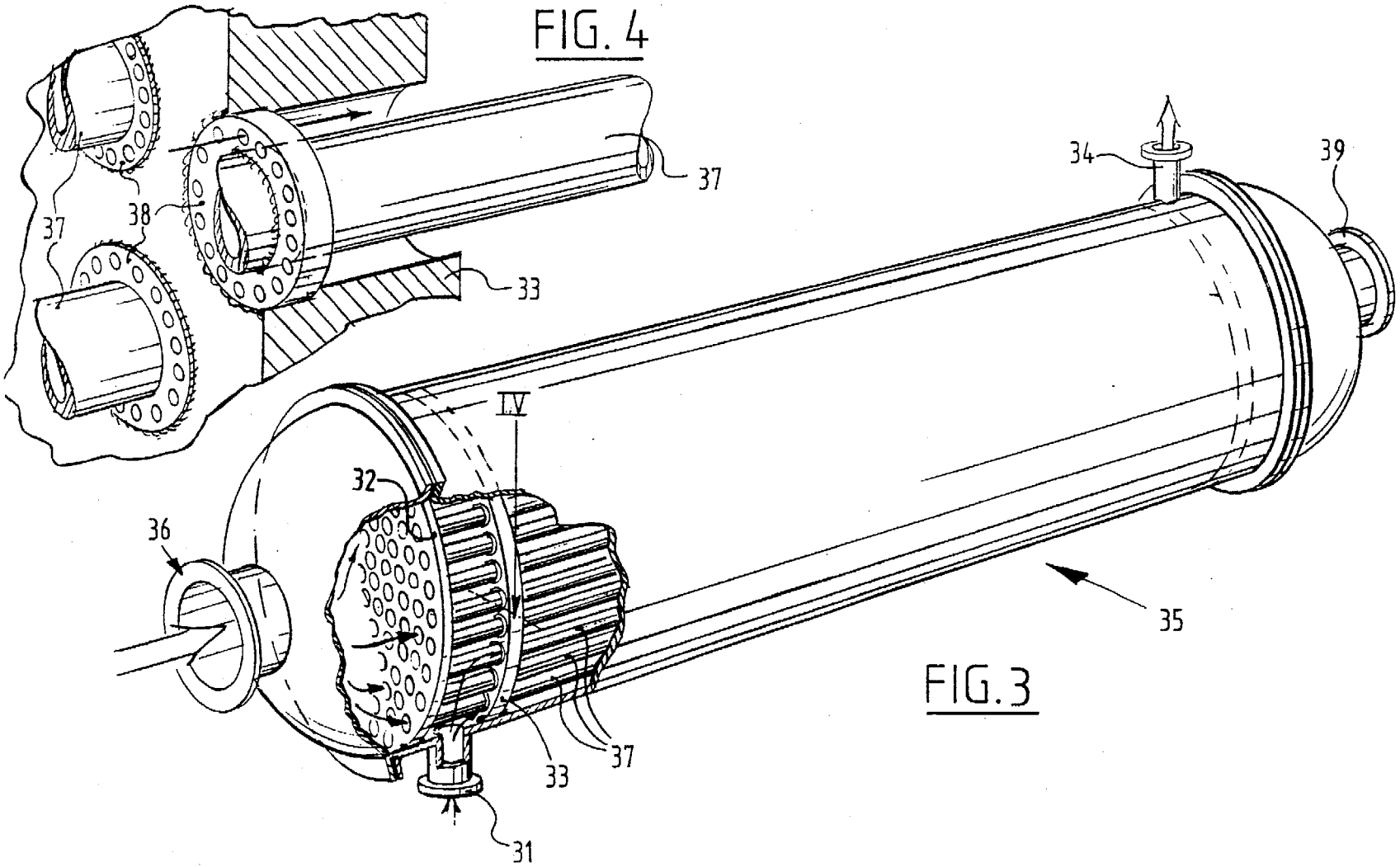
FIG. 3 a partly broken away perspective view of a second preferred embodiment of the device according to the present invention.
FIG. 4 a view along the broken line IV from FIG. 3.

In a second preferred embodiment of the present invention (FIG. 3 and 4) the coolant is led at a connection 31 into an area between a pipe plate 32 and a support plate 33 and via a discharge connection 34 transported out of the heat exchanger 35. The warm or hot gas is led in via a connection 36, via straight pipes 37 through said area and the remaining part led away from the heat exchanger 35 and discharged at a discharge connection 39. The pipes 37 are secured in the support plate 33 by means of rings 38 on the other side to the pipe plate 32, said rings being preferably securely welded to the support plate 33.

The requested rights are in no way determined by the embodiment described here above and shown in the accompanying drawings embodiments but are rather determined by the scope of the following claims.

I claim:

1. An apparatus for cooling a warm medium, comprising:

a vessel wherein a bundle of a number of pipes is disposed and wherein coolant medium flows around the pipe bundle;

a pipe plate through which the pipes of the bundle debouch into a reservoir for supply of the warm medium;

a support plate mounted at a distance from the pipe plate whereby the pipes are supported and wherethrough the pipes extend, wherein one side of the support plate faces the pipe plate; and one or more rings which are each mounted between one of said pipes and the support plate on the side of the support plate facing the pipe plate and terminate at a distance between the support plate and the pipe plate and which are provided with longitudinal holes therethrough for allowing passage of the coolant, such that thermal tension on a portion of said one side of the support plate is minimized.

2. A cooling apparatus according to claim 1, wherein each pipe has a screw-like shape and is connected to a header.

3. A cooling apparatus according to claim 2, wherein the reservoir is provided with a thick layer of insulation material.

4. A cooling apparatus according to claim 2, wherein each ring is welded to the support plate.

5. A cooling apparatus according to claim 1, wherein the reservoir is provided with a thick layer of insulation material.

6. A cooling apparatus according to claim 5, wherein each ring is welded to the support plate.

7. A cooling apparatus according to claim 1, wherein each ring is welded to the support plate.

8. An apparatus for cooling a warm fluid, comprising:

a vessel;

a plurality of pipes through which said warm fluid flows disposed in said vessel, wherein coolant medium flows around said pipes;

a pipe plate having a plurality of pipe plate passages therethrough, wherein a first end of each pipe is disposed in one of said pipe plate passages;

a warm medium supply reservoir, wherein said first ends of said pipes are in fluid communication with said warm medium supply reservoir;

a substantially planar support plate disposed at a distance from said pipe plate, wherein said support plate includes a plurality of support plate passages through which said pipes extend;

a coolant input reservoir disposed between said pipe plate and said support plate; and an annular ring disposed in each of said support plate passages extending into said coolant input reservoir and terminating at a distance between said support plate and said pipe plate, wherein each said pipe passes through an annular ring, and wherein each said ring includes at least one ring passage extending longitudinally therethrough and in fluid communication with said coolant input reservoir, such that thermal tension on a portion of said support plate adjacent said coolant input reservoir is minimized.

9. An apparatus for cooling as claimed in claim 8, wherein said pipe plate is cup-shaped with circumferential ends thereof attached to said support plate to form said coolant input reservoir between said pipe plate and said support plate.

10. An apparatus for cooling as claimed in claim 8, wherein said vessel is substantially upright, and wherein each said pipe has a screw-like shape and a second end of each pipe is connected to a header.

11. An apparatus for cooling as claimed in claim 10, wherein a coolant input pipe passes into said vessel and a first end of said coolant input pipe passes through said support plate into said coolant input reservoir.

12. An apparatus for cooling as claimed in claim 8, wherein each said annular ring is disposed in said support plate passage at an end of said support plate passage facing said pipe plate.

13. An apparatus for cooling a warm medium, comprising:

a vessel;

at least one pipe disposed in said vessel, wherein coolant medium flows around said pipe;

a pipe plate, wherein an end of said pipe extends through said pipe plate and wherein said end of said pipe is in fluid communication with a warm medium supply;

a support plate having at least one pipe passage therein, wherein said support plate is spaced apart from said pipe plate and wherein said pipe extends through said pipe passage; and at least one connecting element disposed in said pipe passage between said pipe and said support plate, wherein said connecting element extends into said coolant medium and terminates at a distance between said support plate and said pipe plate and has at least one passage extending longitudinally therethrough for allowing flow of coolant medium through said passage, such that thermal tension on a portion of said support plate in contact with said coolant medium is minimized.

14. The apparatus as claimed in claim 13, wherein said connecting element is an annular ring.

15. The apparatus as claimed in claim 13, wherein said warm medium supply is a reservoir.

16. The apparatus as claimed in claim 13, wherein said connecting element is positioned near an end of said pipe passage facing said pipe plate.

* * * * *

UNITED STATES PATENT AND TRADEMARK OFFICE

CERTIFICATE OF CORRECTION

PATENT NO. : 5,671,807

DATED : September 30, 1997

INVENTOR(S) : Herman Johannes Lameris

It is certified that error appears in the above-identified patent and that said Letters Patent is hereby corrected as shown below:

Col. 1, line 2, after title insert --BACKGROUND OF THE INVENTION--.

Column 1 Line 7 after "described in" delete --the--.

Signed and Sealed this

Third Day of March, 1998

*Attest:*

*Attesting Officer*

BRUCE LEHMAN

*Commissioner of Patents and Trademarks*